United States Patent [19]

Alexander

[11] Patent Number: 4,887,357

[45] Date of Patent: Dec. 19, 1989

[54] ARTICULATED ENDLESS-BAND SAW BLADE AND SUPPORT THEREFOR

[75] Inventor: Carl J. Alexander, Three Rivers, Mich.

[73] Assignee: Pro Power Corporation, Kalamazoo, Mich.

[21] Appl. No.: 214,745

[22] Filed: Jul. 1, 1988

Related U.S. Application Data

[63] Continuation of Ser. No. 934,397, Nov. 24, 1986, abandoned.

[51] Int. Cl.[4] ..... B27B 17/02; B27B 33/14

[52] U.S. Cl. ..... 30/383; 83/830

[58] Field of Search ..... 83/830, 831, 832, 833, 83/834; 30/383, 386, 380

[56] References Cited

U.S. PATENT DOCUMENTS

| | | | |
|---|---|---|---|
| 1,016,664 | 2/1912 | Bailey | 83/831 X |
| 2,308,847 | 1/1943 | Wolf | 83/832 |
| 2,351,112 | 6/1944 | Day | 83/832 |
| 3,323,561 | 6/1967 | Lahtinen | 30/383 |
| 3,414,026 | 12/1968 | Merz | 30/386 |
| 3,870,125 | 3/1975 | Gorski | 30/383 |
| 3,967,378 | 7/1976 | Arff et al. | 30/383 |
| 4,309,931 | 1/1982 | Alexander | 83/832 |
| 4,464,964 | 8/1984 | Alexander | 83/830 |
| 4,562,761 | 1/1986 | Alexander | 83/830 |

*Primary Examiner*—Donald R. Schran

*Attorney, Agent, or Firm*—Gordon W. Hueschen

[57] ABSTRACT

A saw blade and saw-blade support are provided for a power-driven saw. The saw blade has planar cutting members and planar link members which are pivotally connected together. Each cutting member has a recess for receiving a portion of a link member. The saw-blade support is a blade support face, including a generally straight first section for bearing the cutting load, an arcuate second section merging with the straight first section and defining an end of the elongate member, and an arcuate third section merging with the arcuate second section, but having less curvature than the second section. The end of the saw-blade support carried by the power drive components has an outwardly-flared guide wall for leading said saw blade from the power drive onto the saw-blade support.

13 Claims, 1 Drawing Sheet

ARTICULATED ENDLESS-BAND SAW BLADE AND SUPPORT THEREFOR

This is a continuation of U.S. patent application Ser. No. 934,397, filed Nov. 24, 1986 now abandoned.

FIELD OF THE INVENTION

The invention relates to an articulated endless-band saw blade and a support therefor which is adapted for coaction with power-drive mechanisms.

BACKGROUND OF THE INVENTION AND PRIOR ART

The present invention relates to power-driven saws having endless, closed-loop cutting elements or bands, and more particularly to an endless-band saw blade and to a blade support therefor.

Various designs have been proposed for power-driven saws having endless, closed-loop cutting elements. Chain saws have such cutting elements. However, chain saws typically have relatively thick cutting members which provide a relatively wide kerf. A wide kerf is undesirable for two reasons: (1) the wide kerf removes more material from the cut than does a narrower kerf and thus converts a larger portion of the material being cut to waste, and (2) removal of more material from the wide cut requires more power input for operating the saw. Thus, it would be desirable to provide a saw having narrower cutting elements.

A number of designs have been proposed for power-driven saws having endless, closed-loop cutting elements wherein the cutting elements are supported on a blade support assembly which includes a peripheral groove for receiving a projecting portion of a cutting element or of a connecting element associated with the cutting element. This groove can fill up with the cut material chips or dust. This increases friction between the cutting elements and the saw blade support assembly leading to a decrease in saw speed.

Efforts to overcome these difficulties, as shown in my prior U.S. Pat. Nos. 4,309,931; 4,464,964; and 4,562,761, have not been entirely satisfactory, especially where deep cuts are required. These prior art devices also were not entirely satisfactory in regard to tracking, especially where it is desired to rotate the saw blade in both directions. Also, the prior art devices were not entirely satisfactory in the ease with which the support can be mounted for cooperation with the power-drive components.

It is an object of the invention to provide a saw blade and saw-blade support that overcomes the disadvantages of the prior art. Further objects will appear as the description proceeds.

SUMMARY OF THE INVENTION

A saw blade is provided for coacting with a saw-blade support, and includes an endless band of cutting members. Each cutting member has a pair of parallel, oppositely-facing, substantially planar sides, a top margin with a plurality of cutting teeth, a pair of end margins, and a bottom margin defining transverse bearing faces for slidably abutting the saw-blade support. Each planar cutting member has a reduced thickness portion at each end margin below the cutting teeth for defining a recess extending to said bottom and side margins in each side.

Planar link members are provided in two substantially parallel rows. A portion of each link member is received in a recess of one cutting member and in a recess of an adjacent cutting member.

Means are provided for pivotally-connecting each cutting member to the link member that is received in each recess in the cutting member. A portion of the link member extends beyond the bearing faces of the two adjacent cutting members which are pivotally-connected to the link member when the two adjacent cutting members are oriented to lie in a generally straight line.

A saw blade support is provided for the articulated, endless-band saw blade. The support comprises an elongate support member having a first end for being carried by the power-drive components of the saw and having a second end extending from the first end. The support member has at least a peripheral portion that is generally planar. The peripheral portion defines two substantially parallel side surfaces and a transverse blade-support face extending between said two side surfaces.

The peripheral portion transverse blade-support face includes (a) a generally straight first section for bearing the cutting load, (b) an arcuate second section merging with said straight first section and defining the second end of said elongate member, and (c) an arcuate third section merging with said arcuate second section but having less curvature than said second section, and extending to the first end.

The cutting members have bearing faces for sliding engagement with the blade support. The bearing faces comprise flat end portions parallel with the upper, toothed, margins whereby, when the cutting members are sliding on a flat section of the support, the end bearing faces will lie in flat, face-to-face contact with the flat section and middle portions sloping upwardly toward each other at an angle such that, when a cutting member is over an arcuate or semicircular portion of the support, each middle bearing face will be normal to a radius thereof.

Cam faces are also provided on said support member to aid in guiding the saw blade onto the support.

In a preferred embodiment of the saw-blade support, a pair of spaced-apart guide walls are provided adjacent the parallel side surfaces at the first end to guide portions of the blade onto the support-member first end when the saw blade is being driven in a first direction about the support member.

Also, in the preferred embodiment of the saw-blade support, a second pair of spaced-apart guide walls are provided adjacent the parallel side surfaces at the first end to guide portions o f the blade onto said support-member first end when the saw blade is being driven about the support member in a second, opposite direction.

Numerous other advantages and features of the present invention will become readily apparent from the following detailed description of the invention and embodiment thereof, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

Figures 1, 2, 3, 4:
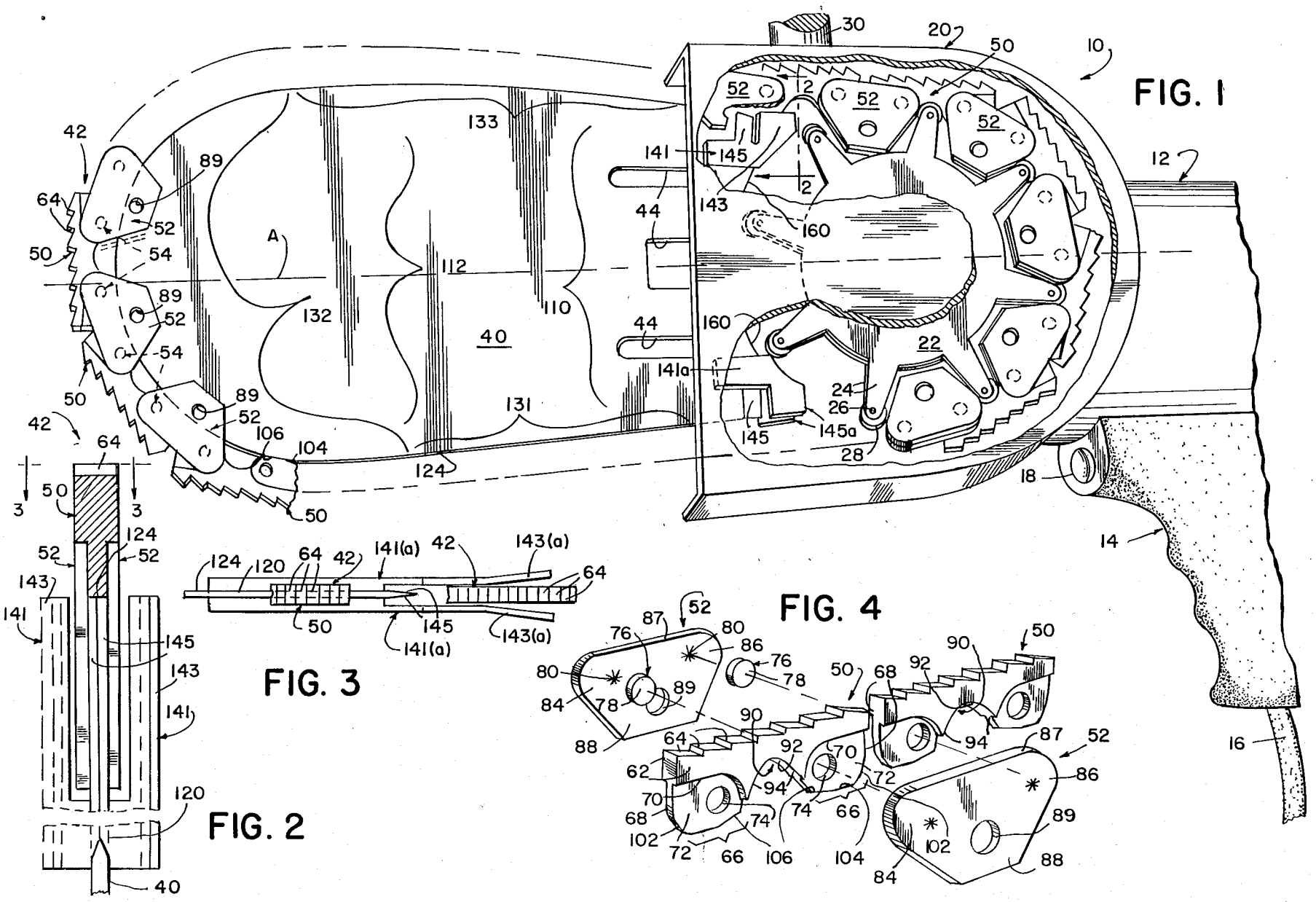
FIG. 1 is a fragmentary, perspective view of a saw that includes a saw blade and saw-blade support of the present invention, it being realized that certain portions of the saw have been broken away to show interior detail.
FIG. 2 is a greatly enlarged, fragmentary, cross-sectional view taken along the plane 2—2 of FIG. 1 throughout the saw blade and showing part of the first end of the saw-blade support.
FIG. 3 is a reduced, fragmentary, top plan view taken generally along the plane 3—3 of FIG. 2.
FIG. 4 is an exploded, perspective view of a portion of the saw blade.

While this invention is susceptible of embodiment in many different forms, this specification and the accompanying drawings disclose only one specific form as an example of the use of the invention. The invention is not intended to be limited to the embodiments so described, and the scope of the invention will be pointed out in the appended claims.

By way of description, the apparatus of this invention is described in the normal (upright) operating position, and terms such as upper, lower, horizontal, etc., are used with reference to this position. It will be understood, however, that the apparatus of this invention may be manufactured, stored, transported, used, and sold in an orientation other than the position described.

The apparatus of this invention is used with conventional components or mechanisms, the details of which, although not fully illustrated or described, will be apparent to those having skill in the art and an understanding of the necessary function of such components.

Some of the figures illustrating the preferred embodiment of the apparatus show structural details and mechanical elements that will be recognized by one skilled in the art. However, the detailed descriptions of such elements are not necessary to an understanding of the invention, and accordingly, are not herein presented.

With reference to FIG. 1, a power-driven saw 10 is illustrated with a saw blade and saw-blade support embodying the principals of the present invention as described in detail hereinafter. The saw 10 includes a hand-holdable power unit 12 which houses a suitable motor (not visible) and which includes a pistol-grip handle portion 14 through which electric power is delivered by a cord 16, the electric power to the motor being controlled by an appropriate trigger switch 18. An additional handle 30 can be provided on the saw 10 for facilitating convenient use and manipulation of the saw 10 during cutting operations.

The saw 10 also includes a suitable protective cover 20 which encloses a drive sprocket 22 which has a plurality of circumferentially-spaced pairs of spaced-apart, parallel spokes 24. A shaft 26 is mounted between each pair of spaced-apart, parallel spokes 24, and a roller 28 is mounted on each shaft 26.

The sprocket 22 is mounted in the saw 10 by conventional means (not visible) and is operatively-connected with the saw motor by conventional means (not visible) whereby rotation of the sprocket 22 may be effected by pressing the trigger switch 18.

The saw 10 includes a saw-blade support 40 for supporting an articulated endless-loop band saw blade 42, which as described in more detail hereinafter, is carried by, and is supported on, the saw-blade support 40 for high-speed movement generally about the periphery of the support 40.

The saw-blade support 40 is, in turn, carried by the other saw components (not visible) under the protective cover or housing 20. To this end, appropriate guideways, slots, or apertures 44 may be provided in the support 40 for cooperating or coacting with the mounting components within the saw 10. One example of such saw blade mounting components which may be adapted for use with the illustrated saw-blade support 40 is described an illustrated in United States Patents referred to above. Other special or conventional mounting means may be provided. The detailed design and specific structure of the means for mounting the saw-blade support 40 to the other components of the saw 10 form no part of the present invention.

With continued reference to FIG. 1, the saw blade 42 includes a plurality of planar cutting members 50, a plurality of planar link members 52, and connecting means 54 for pivotally-connecting each cutting member 50 to a link member 52. The structure of each component of the saw blade 42 is illustrated in greater detail in FIG. 4. Each cutting member 50 has a pair of oppositely-facing sides or surfaces 62, a top margin with a plurality of teeth 64, a bottom margin defining transverse bearing faces 66 for slidably abutting the saw blade support 40, and a pair of end margins 68.

Each planar cutting member 50 has a shoulder 70 which overhangs, and in part defines, a recess 72 that forms a reduced thickness portion at each end margin 68. The recess 72 extends to the bottom margin or face 66 at each side 62 of the planar cutting member 50 and to each end margin 68. A portion of each link member 52 is received in a recess 72 of one cutting member 50 and in a recess of an adjacent cutting member 50. When properly mounted within the recess 72 of a cutting member 50, a link member 52 is generally flush with the cutting member side surface 62.

Means are provided for pivotally-connecting each cutting member 50 to the link members 52 that are received in each recess 72 in the cutting member 50, and this means comprises (1) a journal bearing defined in the reduced thickness portion of each cutting member 50 by a circular aperture 74, (2) a journal 76 having a disk configuration with oppositely-facing end surfaces 78 and received in aperture 74, and (3) means for securing each journal 76 at each end surface 78 to one of the link members 52, as with a spot weld 80, or the like.

Each planar link member 52 preferably has a configuration with at least a first end or portion 84, a second end or portion 86, and a depending or third portion 88. The first portion 84 is received in a recess 72 of one cutting member 50, the second portion 86 is received in a recess 72 of an adjacent cutting member 50, and the third portion 88 projects downwardly from the second and third portions. The third portion 88 projects beyond the bearing faces 66 of the two adjacent cutting members 50 pivotally-connected to the link member 52 when the two adjacent connected cutting members 50 are oriented to lie in a generally straight line whereby the saw-blade support 40 can be engaged on either side for retaining the saw blade 42 thereon.

Each link member 52 can also be provided with one or more holes or apertures 89 in the link member third portion 88 for use in centering the saw blade 42 in a fabrication or sharpening jig. Further, each link member 52 preferably has an upper abutment surface 87 (FIG. 4) for abutting the shoulder 70 of a cutting member 50 when the link member 52 is properly received within the recess 72 of the cutting member 50.

Preferably, each cutting member 52 is also provided with a notch 90 opening to the bottom margin bearing face 66 for engaging the rollers 28 on the drive sprocket 22. Each notch is defined by an arcuate wall 92 and by two generally converging walls 94 that merge with the arcuate wall 92.

As best illustrated in FIG. 4, the end margin 68 of each cutting member 50 has the form of an end face which merges with the cutting member bearing face 66 to define an arcuate corner surface 102. Further, while the cutting teeth 64 along the top margin of each cutting member 50 define a generally straight line array, the cutting member bearing face 66 is not uniformly straight or planar. Rather, the bearing face 66 includes (1) rectilinear end portions 104 generally parallel with the cutting face top margin and (2) middle portions 106 extending in from said end portions 104 at an upwardly angled orientation.

The saw-blade support 40 has the form of an elongate support member with (1) a first end 110 (FIG. 1) for being carried by the power-drive components of the saw 10 and (2) a second end 112 extending from the first end. The support member or support 40 has at least a peripheral portion that is generally planar. In the illustrated preferred embodiment, the entire support member or support 40 is generally planar. The support 40, or at least the peripheral portion thereof, defines two substantially parallel side surfaces 120 (FIGS. 2 and 3) and a transverse blade-support face 124 extending between the two side surfaces 120.

With reference to FIG. 1, at least a peripheral portion of the transverse blade-support face 124 includes the following: (a) a generally straight first section 131 for bearing the cutting load, (b) an arcuate second section 132 of about 180 degrees, merging with the straight first section 131, and (c) an arcuate third section 133 merging with the arcuate second section 132, but having a curvature, say not more than about 10 degrees, substantially less than the second section 132.

The first end 110 of the elongate support member or support 40 is adapted to accommodate the extension of the endless-loop saw blade 42 away from the first end 110 of the support 40 whereby the saw blade 42 can be engaged and driven by drive components of the saw 10, such as the drive sprocket 22. To this end, the first end 110 of the support 40 defines a semicircular recess 160 for accommodating rotation of the drive sprocket 22 in close proximity to the support 40.

The support 40 also includes a first pair of spaced-apart guide walls 141 adjacent the blade-support face third section 133. The walls 141 function to guide portions of the blade 42 onto the support 40 when the saw blade 42 is being driven in a first direction (counterclockwise, as viewed in FIG. 1) about the support 40. Each guide wall 141 includes an outwardly-flared portion 143. This serves to guide the cutting members 50 and link members 52 into alignment with the support 40.

To further guide the cutting members 50 and link members 52 onto the support 40, the support 40 defines cam surfaces 145 (FIGS. 2 and 3) at the first end 110 of the support 40. The cam surfaces 145 converge from the side surfaces 120 of the support 40 to define an edge.

Preferably, the saw-blade support 40 also includes a second pair of spaced-apart guide walls **141*a* (FIG. 1) adjacent the blade-support face first section 131 at the support first end 110. These walls have outwardly-flared portions 143*a* and function to guide portions of the blade 42 onto the support 40 when the saw blade 42 is being driven about the support 40 in a second, opposite direction (clockwise, as viewed in FIG. 1). The support 40 also defines converging cam surfaces 145 adjacent the second pair of spaced-apart guide walls 141*a*–143*a* to further guide portions of the blade 42 onto the support 40. The guide walls 141–143 and 141*a*–143*a*** are left and right hand images.

Both the first pair of guide walls 141 and the second pair of guide walls **141*a* may be secured to the support 40** by suitable means, such as by welding or with appropriate fasteners.

Preferably, the elongate planar support member of the support 40 is not symmetrical with respect to the longitudinal axis A (FIG. 1). The first section 131, where the cutting load is typically applied, is generally straight; however, the oppositely-facing third section 133 is somewhat curved.

The novel saw blade 42 is adapted to be guided by, and properly bear against, the support 40 as the saw blade 42 is driven around the support 40. To this end, when the cutting members 50 are driven along the support first section 131, the upwardly-directed cutting force urges the cutting member bearing faces 66 against the transverse blade support face 124 of the support 40 in the first section 131. More specifically, the generally straight end portions 104 of each cutting member 50 constitute first bearing face which are forced into generally planar contact, i.e., flat, face-to-face contact, with the transverse blade support face 124.

The angled middle portions 106 of the cutting members 50 are not in contact with the transverse blade support face 124 in the first section 131 of the support 40. However, when the cutting members 50 are in the semicircular second section 132 of the support 40, the upwardly-angled middle portions 106 of the cutting members 50 are oriented such that they are normal to radii of the semicircular section and the end portions 104 pivot out of contact with the blade support face. This tends to eliminate, or at least substantially reduce swaging of the cutting members 50.

Although the saw 12 has been illustrated as including an electrically-operated motor, it is to be realized that power may alternatively be provided by any other suitable prime mover, including a pneumatically-operated motor, a hydraulically-operated motor, or an internal combustion engine.

Preferably, the cutting members 50 of the blade 42 are hardened to match the hardness of the blade support 40. Since each cutting member 50 is pivotally-connected within the blade 42, each cutting member 50 need not be particularly flexible and the cutting members 50 can therefore be fabricated with greater hardness tempers.

Further, it is seen that the journal 76 and journal bearing 74, which serve to connect the cutting members 50 with the link members 52, provide a compact connection means with appropriate strength for cutting operations.

Additionally, the unique structure wherein the link members 52 are flush-mounted within the recesses 72 of the cutting members 50 provides a relatively thin blade having relatively smooth sides for producing a relatively narrow kerf. Moreover, the upper abutment surfaces 82 of the link members 52 coact with the shoulders 70 so that, when the chain is opened up to 180 degrees, the cutting members 50 line up to form a rigid saw blade with the teeth 64 aligned in a straight edge.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. A saw blade, for coacting with a saw-blade support, the peripheral portion of said support defining two substantially parallel side surfaces and a transverse blade-support bearing edge extending between the two side surfaces, which saw blade comprises:

an endless band of cutting members arranged in a single row, having a pair of parallel, oppositely-facing, substantially planar sides;

each cutting member having a substantially planar top margin with cutting teeth therein;

a pair of end margins;

a bottom margin defining bearing faces for slidably abutting the bearing edge of said saw-blade support;

substantially parallel link members free of teeth and arranged in two substantially parallel spaced-apart rows;

means pivotally connecting said cutting members to said link members to form said endless band with extended portions of said link members extending beyond the bearing faces of said cutting member and being disposed along both side faces of said saw-blade support when two adjacent cutting members are oriented to lie on said saw-blade support with their top margins in a generally straight line, thereby forming retaining means for retaining said saw blade on said saw-blade support;

each said cutting member having a reduced thickness portion at each end margin below said cutting teeth for defining a recess extending to said bottom and side margins in each planar side thereof; and a portion of each said link member being received in a recess provided in one cutting member and another portion thereof being received in a recess provided in an adjacent cutting member to form said endless band having the outer surfaces of said link members flush with the outer surfaces of said cutting members.

2. The saw blade of claim 1 in which each said cutting member is provided with a notch opening to said bottom margin for engaging a drive means for said saw blade, said notch being defined by an arcuate wall and by two generally converging walls that merge with said arcuate wall; and in which each said cutting member has a generally straight top margin and in which each said cutting member face includes (1) a first flat portion generally parallel with said planar cutting face top margin and (2) a second portion extending to one of said converging walls from said first portion at an upwardly-angled orientation.

3. The saw blade of claim 1 in which a portion of each said cutting member side defines an outwardly-facing side surface; in which each said cutting member recess receives one end of one of said link members substantially flush with the outwardly-facing side surface of said cutting member; in which each said cutting member has an elongate shoulder overhanging and, in part, defining each said recess and said outwardly-facing side surface; and in which each said link member has an upper margin defining an upper abutment surface for abutting said shoulder, so that when said chain is opened up to 180 degrees, said cutting members line up to form a rigid saw blade with the teeth of said cutting members aligned in a straight edge.

4. A saw blade in claim 3 in which each said link member has at least first, second and third portions, said first portion being received in a recess of one cutting member, said second portion being received in a recess of an adjacent cutting member, and said third portion projecting beyond said first and second portions and constituting said extended portions, said first and second portions having a continuous, uninterrupted, rectilinear upper surface which comprises said abutment surfaces.

5. A saw blade, for coacting with a saw-blade support, the peripheral portion of which support defines two substantially parallel side surfaces and a transverse blade-support face extending as a bearing edge between the two side surfaces, which saw blade comprises:

an endless array of substantially planar cutting members which are disposed substantially end-to-end to form a substantially planar articulated band;

each said cutting member having a pair of oppositely-facing sides, a pair of end margins, a top margin with a plurality of cutting teeth thereon to define a cutting face extending transversely between said sides and longitudinally between said end margins, and a bottom margin defining transverse bearing faces for slidably abutting the bearing edge of said saw-blade support;

said saw blade further comprising planar link members arranged in two substantially parallel rows;

each said link member being free of teeth and having an extended portion extending beyond said bearing faces of the two adjacent cutting members pivotally-connected to said link member when the two adjacent connected cutting members are oriented to lie in a generally straight line whereby said saw-blade support can be engaged for retaining said saw blade thereon;

said planar cutting members being situated in said array so as to present a circumferential row of cutting teeth about the periphery of said band;

each said planar cutting member having reduced thickness portions defining a recess at each said end margin in each said side, each said recess extending to said side bottom margins and having a downwardly-facing rectilinear abutting surface spaced from and parallel to said top margin;

each said link member having at least three portions with a first portion received in a recess of one cutting member, a second portion received in a recess of an adjacent cutting member, and a third portion projecting beyond said first and second portions and constituting said extended portions;

said first and second portions having a continuous, uninterrupted, rectilinear, upwardly-facing, abutting surface adapted to abut said downwardly-facing abutting surfaces to form a rigid saw blade when said cutting members are aligned with their top margins in a common cutting plane, and said saw blade further comprising means for pivotally-connecting each said cutting member to each link member received in each recess in the cutting member, the outer face of each link member being flush with the outer face of a cutting member in which it is recessed.

6. A saw-blade support for an articulated, endless-band saw blade in a power driven saw, said support comprising an elongate support member having a first end for being carried by the power-drive components of said saw and having a second end remote from said first end, said support member having a peripheral portion that is generally planar, said peripheral portion spanning two substantially parallel side faces in which said elongate support member first end is adapted to accommodate an extension of said endless-band saw blade away from said first end of said support member for being engaged and driven by drive components of said saw;

in which said saw-blade support includes a first pair of spaced-apart guide walls adjacent said parallel side surfaces at said first end to guide portions of said blade onto said support member first end when said saw blade is being driven in a first direction about said support member;

in which each said guide wall includes an outwardly-flared portion; and in which said support member defines cam surfaces at said first end which converge to an edge from the side surfaces of said support member in a position to guide said saw blade onto said first end when the blade is running in the cutting direction.

7. The saw-blade support of claim 6 including a second pair of spaced-apart guide walls adjacent said blade-support parallel side surfaces at said first end to guide portions of said blade onto said support-member first end when said saw blade is being driven about said support member in a second, opposite direction.

8. The saw-blade support of claim 7 in which said support member defines additional cam surfaces at said first end which converge to an edge from the side surfaces of said support member in a position for guiding said saw blade onto said first end when the blade is running in the reverse direction.

9. In a chain saw having a power-drive mechanism, a saw-blade support anchored thereto and projecting therefrom, and an endless chain of saw-blade members driven by said power-drive mechanism around the periphery of said support and having bearing faces in sliding engagement with the periphery of said support;

the improvement in which:

said periphery comprises a bottom portion on the bottom of said support, a top portion on the top of said support, and an end portion connected tangentially with said top and bottom portions, said bottom portion being rectilinear, and said end portion being semicircular; and said bearing faces of said saw-blade members comprise rectilinear end portions which are parallel with the bottom portion of said support so that, when a saw-blade member is riding on the rectilinear portion of said support, said rectilinear end portions will lie flat on and in face-to-face contact with said rectilinear portion, and middle portions which extend in from said end portions toward each other at angles such that, when the saw-blade member is riding on the portion of the periphery of said support which is semicircular, said middle portions will be normal to radii of said semicircular portion and said flat portions will not be in contact therewith.

10. A chain saw of claim 9 in which said middle portions are separated by a notch adapted to cooperate with said power-drive mechanism to drive said endless belt about said support.

11. A chain saw of claim 10 in which said notch has sides which flare downwardly and said middle portions slope upwardly at their stated angles to intercept said sloping sides, said end and middle portions and the sides of said notch being one continuous surface stretching from one end of said cutting member to the other.

12. A cutting element for a chain saw which comprises a first blade member having a rectilinear cutting edge with a plurality of teeth therein and an opposite edge, said opposite edge having rectilinear end portions parallel to said cutting edge, a centrally-located notch having downwardly-diverging sides symmetrically disposed about a transverse centerline, and middle portions which slope from said end portions to merge with said diverging sides.

13. A cutting element of claim 12 in which said middle portion slopes at an angle such that, when the cutting element is riding around the return curvature of the blade support, said middle portion will be essentially normal to the radius of curvature.

* * * * *